US007354039B2

(12) United States Patent
Bantlin et al.

(10) Patent No.: US 7,354,039 B2
(45) Date of Patent: Apr. 8, 2008

(54) APPARATUS FOR PICKING UP AN AUXILIARY PILE DURING RENEWAL OF A MAIN PILE WHEN FEEDING SHEETS TO A PRINTING MACHINE

(75) Inventors: Michael Bantlin, Wiesloch (DE); Wolfgang Dolz, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 561 days.

(21) Appl. No.: 10/883,257

(22) Filed: Jun. 30, 2004

(65) Prior Publication Data

US 2004/0262834 A1 Dec. 30, 2004

(30) Foreign Application Priority Data

Jun. 30, 2003 (DE) ..... 103 29 305

(51) Int. Cl.
*B65H 31/12* (2006.01)

(52) U.S. Cl. ..... 271/218; 414/790.8

(58) Field of Classification Search ..... 271/218, 271/157–159; 414/789.9, 790.8
See application file for complete search history.

(56) References Cited

U.S. PATENT DOCUMENTS 5,295,681 A * 3/1994 Blaser ..... 271/241
5,927,710 A * 7/1999 Pollich et al. ..... 271/218
6,135,445 A * 10/2000 Gamperling et al. ..... 271/220
6,616,114 B2 9/2003 Zahn et al.
6,752,586 B2 * 6/2004 Baumann et al. ..... 414/790.8
2002/0060398 A1 5/2002 Zahn et al.

FOREIGN PATENT DOCUMENTS

| | | |
|---|---|---|
| DE | 1 082 279 | 5/1960 |
| DE | 42 15 791 A1 | 11/1993 |
| DE | 197 38 029 A1 | 3/1999 |
| DE | 101 30 185 A1 | 1/2002 |
| DE | 101 21 038 A1 | 10/2002 |
| EP | 0 349 436 B1 | 1/1990 |
| JP | 10045267 A | 2/1998 |

* cited by examiner

*Primary Examiner*—Patrick Mackey
*Assistant Examiner*—Jeremy R Severson
(74) *Attorney, Agent, or Firm*—Laurence A. Greenberg; Werner H. Stemer; Ralph E. Locher

(57) ABSTRACT

An apparatus for picking up an auxiliary pile during a renewal of a main sheet pile when feeding sheets to a printing machine. The apparatus has loadbearing elements arranged on a holder for the auxiliary pile, and a positioning device for the loadbearing elements under the auxiliary pile. The loadbearing elements are flexible with respect to positioning forces acting from outside.

3 Claims, 5 Drawing Sheets

APPARATUS FOR PICKING UP AN AUXILIARY PILE DURING RENEWAL OF A MAIN PILE WHEN FEEDING SHEETS TO A PRINTING MACHINE

BACKGROUND OF THE INVENTION

Field of the Invention

The invention relates to an apparatus for picking up an auxiliary pile during the renewal of a main sheet pile when feeding sheets to a printing machine. The apparatus has loadbearing elements disposed on a holder for the auxiliary pile, and a positioning device for the loadbearing elements under the auxiliary pile.

German published patent application DE 42 15 791 A1 describes a stacking table wherein, in order to hold an auxiliary pile temporarily, chains arranged in parallel in one plane are provided which, after being placed on loadbearing rails, are capable of bearing the load in the direction of the weight of the auxiliary pile. The chains can be inserted by a motor into grooves in the main pile pallet from a standby position. Before the chains are inserted into the grooves, the chain guide is pre-positioned in the vertical and horizontal direction with respect to the grooves with the aid of a sensor. The sensor is aimed at the outer edge of the pallet.

For the purpose of vertical and horizontal alignment of loadbearing rods in relation to pallet grooves, the solution according to German published patent application DE 101 21 038 A1 provides sensors which are fixed to the guide for the loadbearing rods and are aimed at the vertically running edges of the pallet grooves.

In the stacking apparatus according to Japanese published patent application JP 10045267 (A), the lateral alignment of loadbearing rods for picking up an auxiliary pile is carried out with sensors. The sensors are aimed at a mark which is disposed on a pallet having pallet grooves.

In the solutions according to the prior art, there is the risk that the loadbearing elements for the auxiliary pile will not meet the pallet grooves accurately on account of dimensional and positioning inaccuracies, so that time-consuming repositioning is required and the loadbearing elements and/or the pallets can be damaged.

SUMMARY OF THE INVENTION

It is accordingly an object of the invention to provide an apparatus for handling an auxiliary sheet pile during the renewal of the main sheet pile in a feeder of a printing machine which overcomes the above-mentioned disadvantages of the heretofore-known devices and methods of this general type and which permits quick and reliable positioning of loadbearing elements under the auxiliary pile.

With the foregoing and other objects in view there is provided, in accordance with the invention, an apparatus for picking up an auxiliary pile during renewal of a main pile when feeding sheets to a printing machine. The apparatus comprises: a holder for holding the auxiliary pile; the holder including loadbearing elements to be placed underneath the auxiliary pile; and the loadbearing elements are flexible elements configured to yield to externally acting positioning forces.

In other words, the loadbearing elements individually or the holder of the loadbearing elements is of flexible design. If a loadbearing element strikes a resistance when being positioned under an auxiliary pile, the loadbearing element is deflected in the horizontal and/or vertical direction. If the loadbearing elements are designed to be conical at the front, then the insertion of the loadbearing elements into pallet grooves can be carried out in spite of mechanical resistance. In particular, the loadbearing elements can be equipped with insertion bevels, which makes it possible to thread the loadbearing elements into the pallet grooves. The positioning system for the holder or the loadbearing elements in the horizontal and vertical direction can be designed with lower requirements. The loadbearing elements merely need to be pre-positioned. The geometry of the loadbearing elements and the flexibility in the horizontal and vertical direction result in inherent guidance of the loadbearing elements with respect to the pallet grooves. Therefore, inaccuracies such as tolerances of the pallet and errors in positioning the loadbearing elements can be compensated for. A sensor system for detecting the position of the pallet grooves can be dispensed with or can be designed with a lower measurement accuracy. Special sensing elements on the pallet are not required.

In a preferred embodiment, the loadbearing elements are combined to form a rake, which is arranged such that it can move with respect to a pallet on an auxiliary pile carrier and is sprung with respect to the latter. Following the pre-positioning of the rake with respect to the pallet grooves, the rake is moved into the grooves and can be centered in the grooves even in the event of any remaining positioning errors.

It is possible to arrange on the auxiliary pile carrier sensors with which the pallet grooves can be looked for or detected. The guides of the loadbearing elements, and therefore the entire auxiliary pile rake, can be arranged to move horizontally and vertically with respect to the pallet grooves and can be sprung with respect to a loadbearing rail which carries the auxiliary pile rake.

It is advantageous if the pallet grooves are detected by at least three optical sensors. For each positioning direction, two sensors can be provided, which are located at a distance within the limitation of the pallet grooves. If one sensor is used both for the vertical and the horizontal alignment of the loadbearing elements for the auxiliary pile, three sensors are sufficient. Instead of a pallet groove, a web between two pallet grooves can be registered by sensors.

In order to make the positioning of the loadbearing elements quicker and more reliable, a pallet on a stack board can be aligned roughly in the lateral direction. The pallet grooves thus lie Within predefined limits. If an electric motor is used when inserting the loadbearing elements into the pallet grooves, then, by monitoring the motor current, it is possible to monitor whether a loadbearing element jams or collides with a pallet web.

The loadbearing elements can come into a preferred position by means of springs if the loadbearing elements are free to move outside the pallet grooves. The loadbearing elements or a holder of the loadbearing elements can preferably be acted on by means of a roller lever and a spring in such a way that the preferred position is assumed even when a certain amount of friction is present. Given small deflections from a preferred position, the roller lever with a roller lifts off a supporting surface and stresses a spring, which immediately produces a restoring force. When the preferred position is reached, two rollers rest on the supporting surfaces, so that no restoring force is effective.

In order to compensate for the weight of the loadbearing elements, including the holder for the loadbearing elements, a counterweight can be provided, which keeps the vertically movable parts in equilibrium. As a result, oscillations onto the holder or the loadbearing elements, which would occur in the case of a cyclic lifting movement of the auxiliary pile, are avoided.

If the holder for the loadbearing elements is arranged on a loadbearing rail, then it is expedient to fix sensors for pallet grooves to the loadbearing rail. The signal from the sensors is then maintained even if the holder or the loadbearing elements carry out a compensating movement during positioning in pallet grooves.

The apparatus is capable of compensating in the horizontal direction for errors in the groove pitch of the pallet groves. When the loadbearing elements are being inserted into the pallet grooves, the loadbearing elements can reach a position which corresponds to a position averaged over all the grooves.

Other features which are considered as characteristic for the invention are set forth in the appended claims.

Although the invention is illustrated and described herein as embodied in an apparatus for picking up an auxiliary pile during renewal of a main pile when feeding sheets to a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
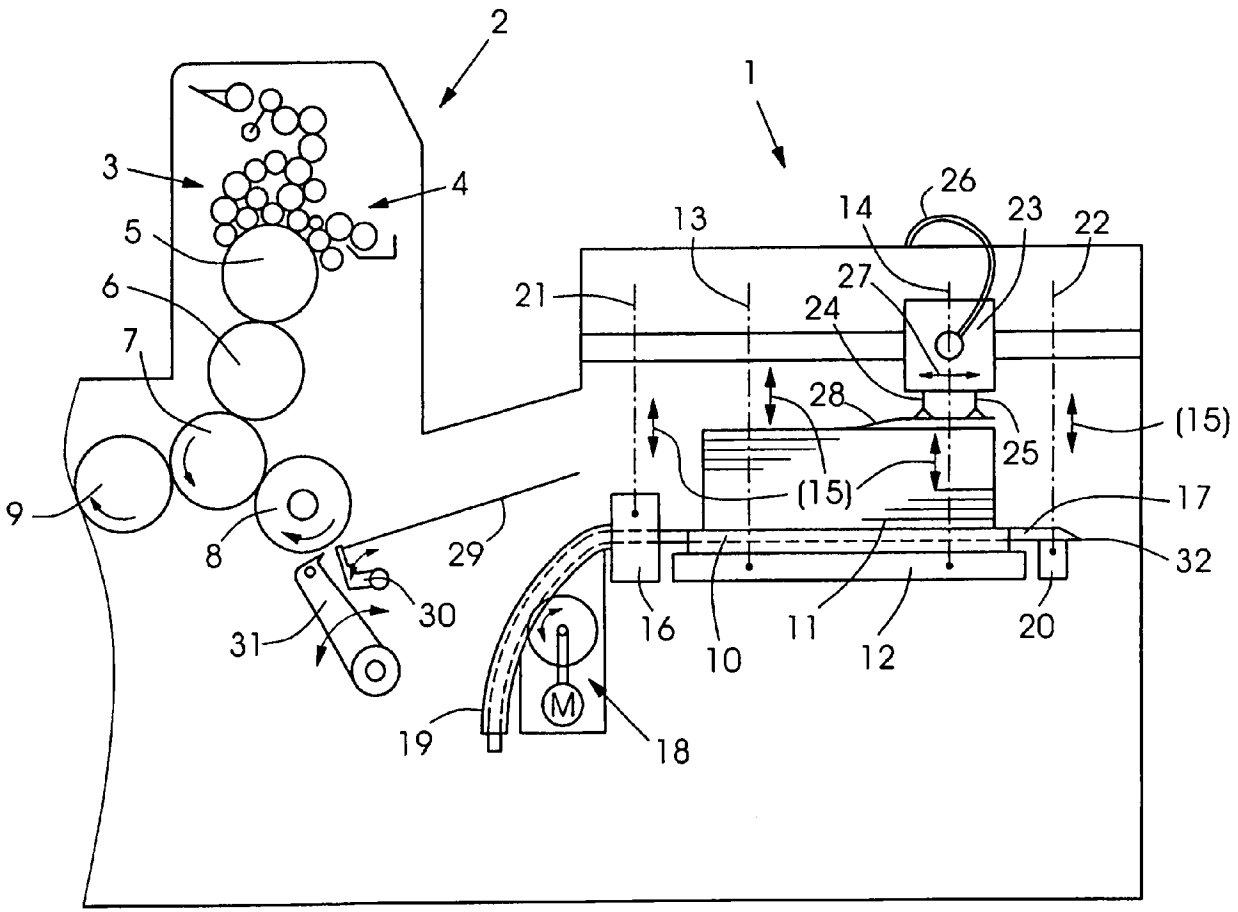
FIG. 1 is a schematic side view of an apparatus for picking up an auxiliary pile in the feeder of a sheet-fed press.

Referring now to the figures of the drawing in detail and first, particularly, to FIG. 1 thereof, there is shown a feeder 1 and a first printing unit 2 of a sheet-fed offset press. The printing unit 2 contains an inking unit 3, a damping unit 4, a form cylinder 5, a transfer cylinder 6, an impression cylinder 7, a feed cylinder 8, and a transport drum 9. Associated with the feeder there is a pallet 10, on which a sheet pile or sheet pile 11 is located. The pallet 10 sits on a stack table 12, which can be moved and positioned in a vertical direction 15 with the aid of chains 13, 14 of a chain mechanism. In order to permit the pile 11 to be renewed during the continuous operation of the sheet-fed offset press, an auxiliary pile apparatus is provided. The auxiliary pile apparatus comprises a holder 16 for a plurality of loadbearing elements 17 arranged in parallel, a feed device 18 and a guide 19 for the loadbearing elements 17 and a front loadbearing rail 20. The holder 16 can be positioned in the vertical direction, together with the guide 19 and the feed device 18, by means of chains 21 of a chain mechanism, and can be positioned in the horizontal direction, at right angles to the plane of the drawing of FIG. 1, by means of a positioning apparatus, not illustrated. The loadbearing rail 20 can be positioned in the vertical direction 15 by means of chains 22 of a chain mechanism. The pallet 10 has webs and grooves. The pile 11 rests on the webs of the pallet 10. By means of the feed device, the loadbearing elements 17 can be positioned through the grooves to such an extent that they rest on the loadbearing rail 20.

During printing, the pile 11 is guided by the chains 13, 14 in a manner corresponding to the printing speed against a suction head 23 having suction grippers 24, 25. Vacuum lines 26 lead to the suction grippers 24, 25. The suction head 23 can be moved to and fro in the horizontal direction 27. Using the suction grippers 24, 25, the sheets 28 lying at the top on the pile 11 are separated or singled and, by means of the movement of the suction head 23, are conveyed onto a feed table 29 against front lays 30. From the front lays 30, the sheets 28 are transferred to the feed cylinder 8 by way of a swinging gripper 31. As it passes through the nip between the impression cylinder 7 and the transfer cylinder 6, the sheet 28 is printed. The transport to further printing units is carried out by the transport drum 9.

In the vertical position shown in FIG. 1 of the stack table 12, the time for renewing the pile 11 has been reached. In order to renew the pile 11, the auxiliary pile 11 with a residue of sheets 28 is picked up for some time on the loadbearing elements 17. For this purpose, the holder 16 with the loadbearing elements 17 is positioned in the vertical and horizontal direction such that the tips 32 of the loadbearing elements 17 point approximately at the centers of the cross-sectional areas of the pallet grooves. After that, the feed device 18 is started up, so that the loadbearing elements 17 pass through the pallet grooves onto the loadbearing rail 20. The loadbearing elements 17 comprise links which are connected in an articulated manner and which, outside the pallet grooves and outside a guide in the holder 16, follow the curved form of the guide 19. After passing through the guide in the holder 16 and after being placed on the loadbearing rail 20, the links of the loadbearing elements 17 are flexurally rigid for the load of the auxiliary pile 11. The auxiliary pile 11 is brought up to the suction grippers 24, 25 by means of the vertical drive of the holder 16 and of the loadbearing rail 20 via the chain mechanisms on the chains 21, 22. In the process, the auxiliary pile 11 with its weight is picked up completely on the loadbearing elements 17. While the auxiliary pile is being brought up to the suction head 23 by means of the chains 21, 22, the stack table 11 with the pallet 10 is lowered via the chain mechanisms on the chains 13, 14, until it assumes a lower position to accommodate a new main pile. Even before the auxiliary pile 11 has been processed, the new main pile is brought up under the loadbearing elements 17 of the auxiliary pile, so that main pile and auxiliary pile 11 are aligned. The loadbearing elements 17 are then retracted in the direction of the guide 19 by means of the feed device 18, so that auxiliary pile 11 and the new main pile combine to form one pile 11. The combined pile 11 is further brought up to the suction head 23 by means of the chain mechanisms and the chains 13, 14.

Figure 2:
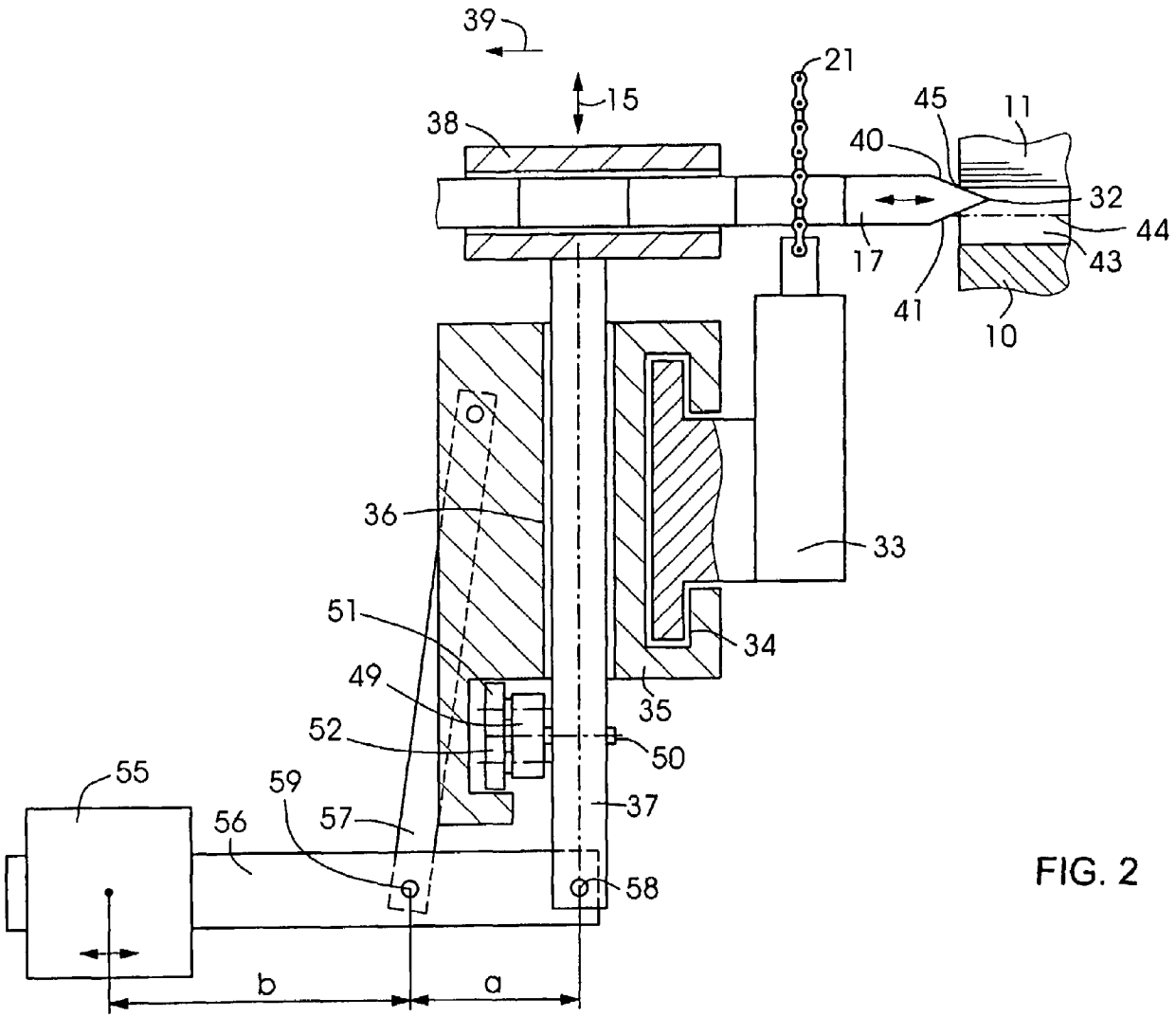
FIG. 2 is a schematic side view showing details of the apparatus relating to a horizontal and vertical compensating movement.

The design construction of the holder 16 will be described below using FIGS. 2 and 3. The holder 16 comprises a loadbearing rail 33 which is suspended on the chains 21. Formed on the loadbearing rail 33 is a horizontal guide 34 for a bearing element 35. A vertical guide 36 for an opening column 37 is formed on the bearing element 35. Guides 38 for the linked loadbearing elements 17 are formed on the loadbearing column 37. By means of the feed device 18, the loadbearing elements 17 can be positioned counter to and in the direction 39 of the sheet run. At the front end, the loadbearing elements 17 have insertion bevels 40, 41. By means of positioning the loadbearing rail 33 with the chains 21 in a vertical direction 15 and in a horizontal direction 42 with positioning elements not illustrated, the holder 16 is brought into a preferred position, from which the feed of the loadbearing elements 17 in the direction of the pallet grooves 43 is started. As FIG. 2 shows, the loadbearing elements 17 have not been pre-positioned so exactly that the tips 32 of the loadbearing elements 17 point at the centre lines 44 of the pallet grooves 43. As a result of this unavoidable mispositioning, as the loadbearing elements 17 are driven forward, the insertion bevels 40 rest on the lower, front end 45 of the pile 11. As a result, as the loadbearing elements 17 are inserted into the pallet grooves 43, forces with a component in the vertical direction 15 are produced on the loadbearing elements 17. As the loadbearing elements 17 are driven forward into the pallet grooves 43, the loadbearing elements 17 are forced downward in the vertical direction in the vertical guide 36 out of the preferred position, counter to the force of a spring 46. The spring 46 is supported on one side on a ledge 47 of the loadbearing column 37 and on the other side on a ledge 48 on a roller lever 49. The roller lever 49 is mounted centrally on the loadbearing column 37 such that it can rotate about a pin 50. Seated at the end of the roller lever 49 are rollers 51, 52 which, in the preferred position of the loadbearing element 17, bear against parallel, horizontal surfaces 53, 54 which are formed on the loadbearing element 75. If, as described above, vertical insertion forces act on the loadbearing elements 17 and the loadbearing column 37 is moved downward, then the roller 52 lifts off the surface 53 and the spring 46 is stressed. The spring 46 then produces a restoring force. As soon as the loadbearing elements 17 have been moved out of the pallet grooves 43, the loadbearing elements 17 once more assume the preferred position as a result of the restoring force.

In order to compensate for the weight of the loadbearing elements, the guide 38 and the loadbearing column 37, a counterweight 55 is provided which, in conjunction with beams 56, 57 that are connected in an articulated manner, keeps the vertically moved elements in equilibrium. The weight 55 is located at one end of the substantially horizontally aligned beam 56. The other end of the beam 56 is fixed in an articulated manner to the loadbearing column 37. The beam 57 is fixed in an articulated manner to the bearing element 35 and to the beam 57. The distance a between the points of articulation 58, 59 on the loadbearing column 37 and on the beam 56 is smaller than the distance b between the centre of gravity of the weight and the point of articulation 59.

Figure 3:
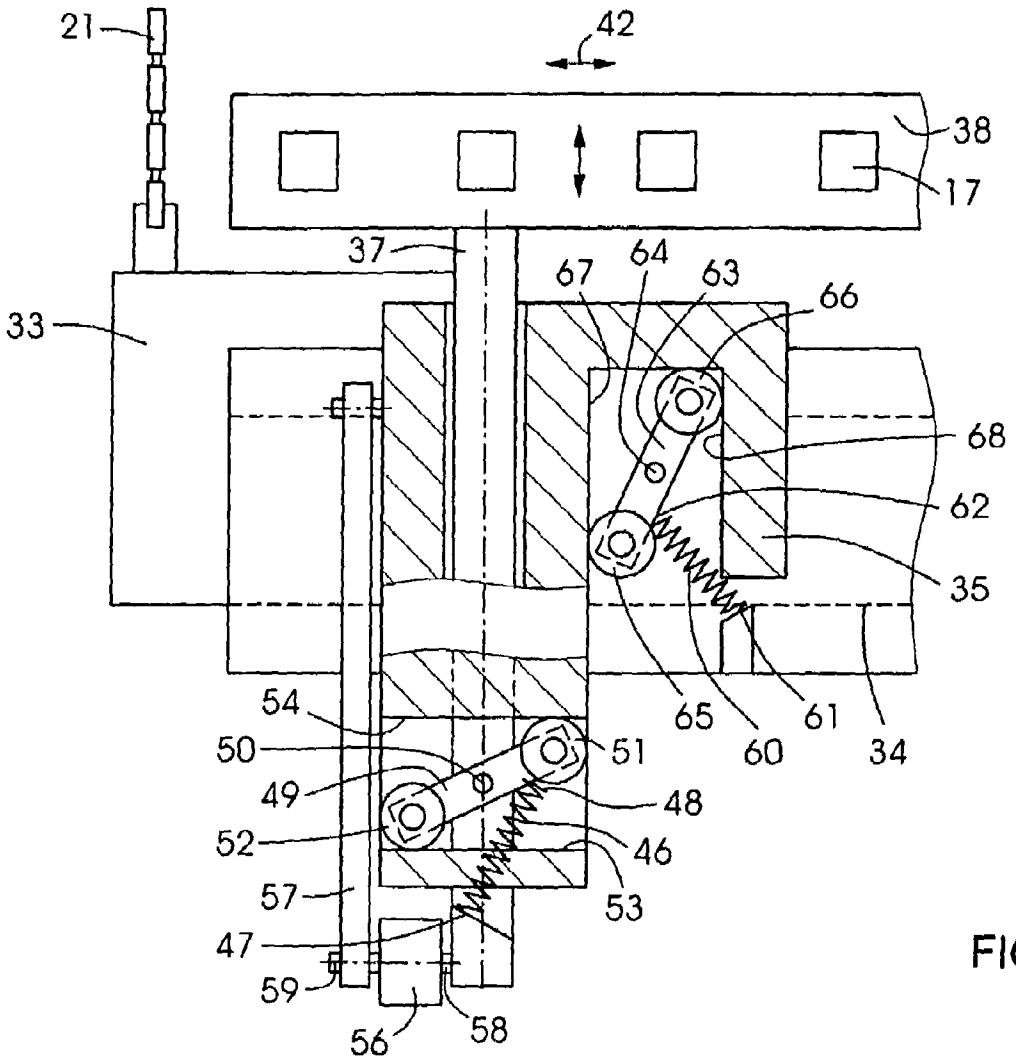
FIG. 3 is a schematic view of the details in a viewing direction orthogonal to FIG. 2.

As emerges in more detail from FIG. 3, the loadbearing elements 17 are also designed to be flexible in the horizontal direction 42 with respect to insertion forces into the pallet grooves 43, in a similar way to that in the vertical direction 15. For this purpose, a further spring 60 is provided, which is supported with one end on a ledge 61 on the loadbearing rail 33 and with the other end against a ledge 62 on a roller lever 63. The roller lever 63 is mounted on the loadbearing rail 33 by a pin 64 such that it can rotate. At the ends of the roller lever 63 there are rollers 65, 66 which, in the preferred position of the loadbearing element 17, bear against parallel vertical surfaces 67, 68. The surfaces 67, 68 are formed opposite each other on the bearing element 35. If, as the loadbearing elements 17 are inserted into the pallet groove 43, an insertion bevel of a loadbearing element 17 slides against a vertical edge of a pallet groove 43, insertion forces with a horizontal component at right angles to the direction 39 of the sheet run occur. As described in the vertical direction 15, the loadbearing elements 17, the guide 38 and the bearing element 35 are then also deflected out of the preferred position in the horizontal direction 42, one of the rollers 65, 66 lifting off the respective surface 67, 68, depending on the direction of the deflection, and stressing the spring 60, forming a restoring force.

Figure 4:
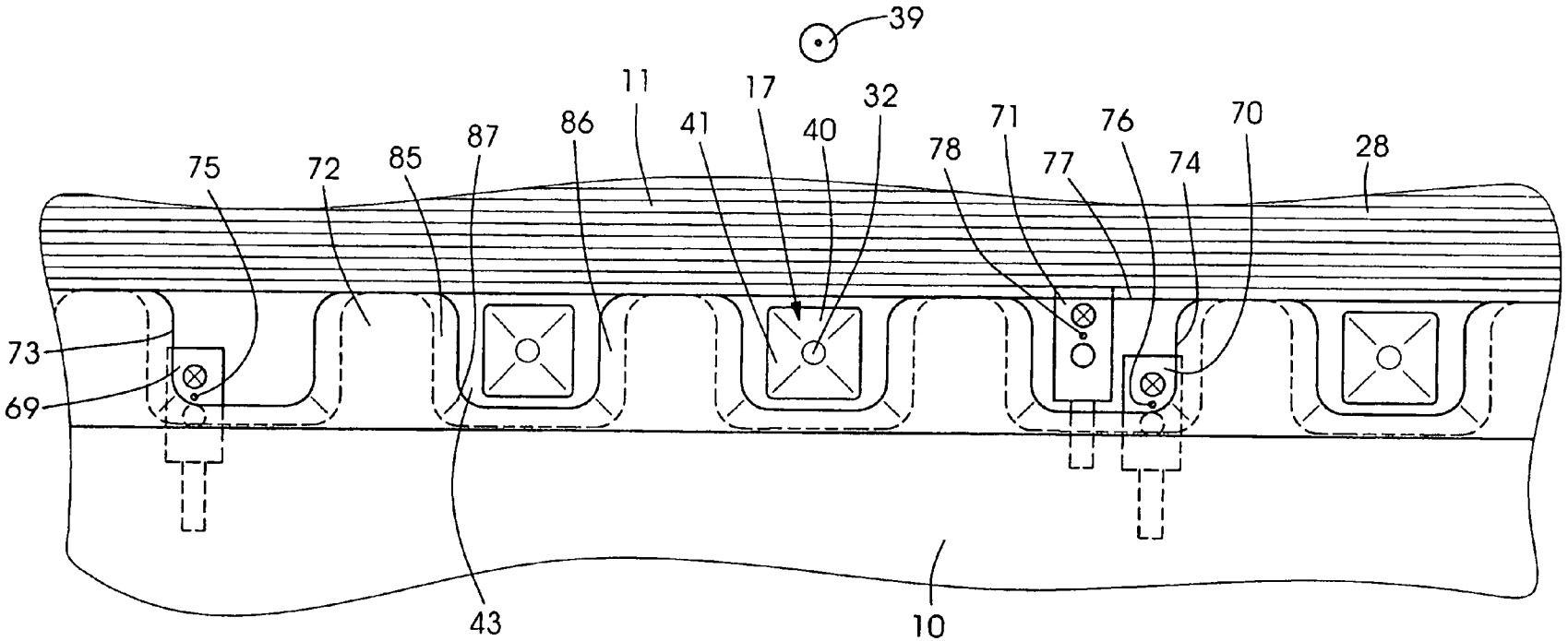
FIG. 4 is a diagram showing an exemplary arrangement of sensors for pallet grooves.
Figure 5:
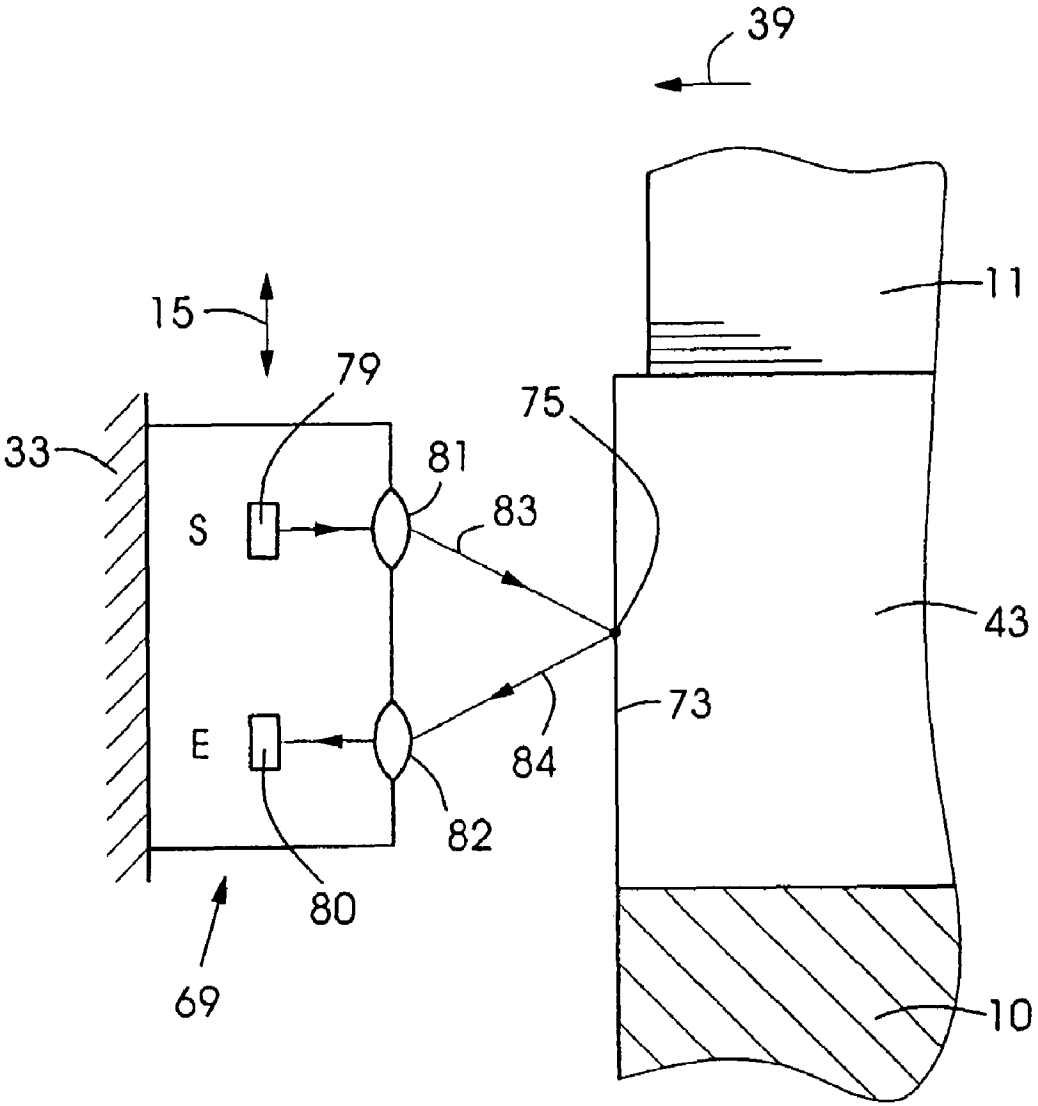
FIG. 5 is a diagrammatic illustration showing the sensing geometry for a sensor for a pallet groove edge.

The control of the pre-positioning of the loadbearing elements 17 with respect to the pallet grooves 43 can be carried out by way of optical reflected light detectors 69-71 which are connected in a fixed manner to the loadbearing rail 33, which is shown in more detail in FIGS. 4 and 5.

FIG. 4 shows an extract from the region of the lower edge of the pile 11 with a view counter to the direction 39 of the sheet transport. The pallet 10 has pallet grooves 43 located at equal distances in the sheet transport direction 39 and webs 72, on which the sheets 28 of the pile 11 rest. For the horizontal positioning of the loadbearing elements 17, two reflected light detectors 69, 70 are arranged on a common horizontal line. For the purpose of vertical positioning of the loadbearing elements 17, a further reflected light detector 71 is provided in conjunction with the reflected light detector 70. The reflected light detectors 69 and 70 are assigned to inverted edges 73, 74 of two different pallet grooves 43 or webs 72. The sensing points 75, 76 are in each case located beside the edges 73, 74 in the direction of the respective pallet groove 43. The reflected light detector 71 is assigned to the lower stack edge 77 in the region of a pallet groove 43. The sensing point 78 of the reflected light detector 71 is located closely underneath the stack edge 77, the sensing point 76 being located in the lower third of the pallet groove 43. If none of the reflected light detectors 69 to 71 registers a web 72 or the front surface of the pile 11, then the loadbearing elements 17 are located in the preferred position for insertion into the pallet grooves 43, as shown in FIG. 4.

FIG. 5 shows the beam path of the reflected light detector 69. The reflected light detectors 69 to 71 each contain an optical transmitter 79, an optical receiver 80 and optical elements 81, 82 for projecting a transmitted light beam onto the sensing point 75 and a received light beam 84 from the sensing point 75 onto the optical receiver 80. With the vertical and lateral positioning of the loadbearing rail 33, the reflected light detectors 69 to 71 are positioned with respect to the pallet grooves 43 until the reflected light detectors 69 to 71 give the desired signals to enable the loadbearing elements 17 to be moved into the pallet grooves 43.

In order to sense the edges 73, 74 of the pallet grooves 43, linear focusing detectors can also be used. In any case, the reflected light detectors 69 to 71 have a certain registration depth in the direction 39 of the sheet transport, so that the pallet grooves 43 can be detected reliably even if the distance between the reflected light detectors 69 to 71 and the pallet 10 has a certain tolerance band or the pallet grooves 43 have insertion bevels 85 to 87 on the inlet side.

This application claims the priority, under 35 U.S.C. § 119, of German patent application No. 103 29 305.1, filed Jun. 30, 2003; the entire disclosure of the prior application is herewith incorporated by reference.

We claim:

1. An apparatus for picking up an auxiliary pile during renewal of a main pile when feeding sheets to a printing machine, comprising:

a holder for holding the auxiliary pile;

said holder including loadbearing elements to be placed underneath the auxiliary pile;

said loadbearing elements being flexible elements configured to yield to externally acting positioning forces;

a guide disposed on said holder, for a horizontal compensating movement of said loadbearing elements;

a second guide mounted to said holder, for a vertical compensating movement of said loadbearing elements;

said holder including a loadbearing rail, a two-armed lever carrying rollers at free ends thereof, and said holder being formed with two mutually parallel surfaces extending perpendicularly to a direction defined by said guide; and a sprung element disposed for biasing said holder in a horizontal preferred position when the positioning forces do not act on the apparatus, said sprung element being a compression spring which, in the preferred position, bears against said loadbearing rail and said two-armed roller lever, with said rollers bearing against said two surfaces formed on said holder.

2. The apparatus according to claim 1, which further comprises a lever configuration with a counterweight for compensating for a weight of said holder and said loadbearing elements.

3. An apparatus for picking up an auxiliary pile during renewal of a main pile when feeding sheets to a printing machine, comprising:

a holder for holding the auxiliary pile;

said holder including loadbearinq elements to be placed underneath the auxiliary pile;

said loadbearing elements being flexible elements configured to yield to externally acting positioning forces;

a guide disposed on said holder, for a horizontal compensating movement of said loadbearing elements;

a second guide mounted to said holder, for a vertical compensating movement of said loadbearincq elements;

said holder including a loadbearing rail, a two-armed lever carrying rollers at free ends thereof, and said holder being formed with two mutually parallel surfaces extending perpendicularly to a direction defined by said second guide; and a sprung element disposed for biasing said holder in a vertical preferred position absent action of the positioning forces, said sprung element being a compression spring which, in the preferred position, bears against said loadbearing rail and said two-armed roller lever, with said rollers bearing against said two surfaces formed on said holder.

* * * * *